United States Patent [19]

Matsui et al.

[11] 4,370,050

[45] Jan. 25, 1983

[54] IMAGE TRANSFER TYPE COPYING APPARATUS WITH PRE-TRANSFER CLEANING OF TRANSFER PAPER

[75] Inventors: Toshio Matsui; Masaru Komura, both of Toyokawa, Japan

[73] Assignee: Minolta Camera Kabushiki Kaisha, Osaka, Japan

[21] Appl. No.: 251,609

[22] Filed: Apr. 6, 1981

[30] Foreign Application Priority Data

Apr. 29, 1980 [JP] Japan ..... 55-59498[U]

[51] Int. Cl.[3] ..... G03G 15/00

[52] U.S. Cl. ..... 355/3 SH; 355/15; 15/1.5 R

[58] Field of Search ..... 355/3 SH, 3 TR, 13, 355/15; 118/652; 15/1.5 R, 256.52

[56] References Cited

U.S. PATENT DOCUMENTS

| | | | |
|---|---|---|---|
| 4,158,498 | 6/1979 | Ohmori | 355/15 |
| 4,181,425 | 1/1980 | Higaya et al. | 355/15 |
| 4,214,833 | 7/1980 | Kono | 355/3 TR |

FOREIGN PATENT DOCUMENTS

| | | | |
|---|---|---|---|
| 53-18140 | 2/1978 | Japan . | |
| 1082910 | 9/1967 | United Kingdom | 15/1.5 R |

*Primary Examiner*—A. D. Pellinen
*Assistant Examiner*—Keith E. George
*Attorney, Agent, or Firm*—Wolder, Gross & Yavner

[57] ABSTRACT

An electrophotographic copying machine of the image transfer type includes a rotated photosensitive drum with a photoconductive peripheral face, a first pair of cooperating rollers for withdrawing successive copy paper sheets from a cassette and advancing them along a path to a second pair of cooperating rollers which is proximate and advances individual sheets to the image transfer station at the drum, the second roll pair being rotated at the peripheral speed of the drum and in timed relation to the drum advanced image. In order to remove paper and other dust from the copy paper delivered to the transfer station, one of the second rolls has a dielectric peripheral face formed, for example, of polyvinyl chloride and the other second roll is formed of rubber. A longitudinally extending cleaning pad frictionally engages the roller dielectric face and is formed of an elastic material, such as a foamed polyurethane, to remove dust from and triboelectrically charge the dielectric face. The pad is longitudinally retractable from the roller across a brush which cleans the pad and deposits the removed dust into an underlying receptacle.

11 Claims, 3 Drawing Figures

IMAGE TRANSFER TYPE COPYING APPARATUS WITH PRE-TRANSFER CLEANING OF TRANSFER PAPER

BACKGROUND OF THE INVENTION

The present invention relates to an improved electrostatic copying apparatus, of the image transfer type, in which an image, such as a toner image, formed on the surface of an image bearing member is transferred to the surface of a transfer medium such as copy paper advanced in engagement with the image bearing surface.

In copying apparatus of the subject type, transfer paper is transported from a copy paper feed station to a transfer station upon the start of a copying operation. During such transport, paper particles and similar dust particles are produced by the frictional contact of the surface of the copy paper with the periphery of a feed roller at the feeding station and also by the frictional contact of the surfaces of the paper with the peripheries of transport rollers provided in the path of transport of the paper or with the surfaces of transport guide plates. Further, with copying apparatus in which an elongated web of the copy paper wound in a roll is successively cut into individual sheets of copy or transfer paper, the paper web, when cut, releases a large amount of paper particles. Much of the dust thus produced adheres chiefly to the surfaces and forward edge of the transported transfer paper. In the apparatus of the type described, therefore, the transfer paper having such dust deposited thereon is fed to the transfer station, and is the source of numerous objections.

Among the objections which may be encountered with a toner image transfer type electrophotographic copying apparatus which is presently in wide use wherein a latent electrostatic image is formed on the surface of an electrophotographic photoconductive member serving as the image bearing member and which is then developed to a toner image, is that when the toner image on the surface of the photoconductive member is electrostatically transferred to the transfer paper advanced into engagement with the photoconductive member, much of the dust on the transfer paper is attracted to the photoconductive surface. Consequently, the following drawbacks may result from the thus attracted dust.

The copying apparatus of the above image transfer type includes a cleaning unit by which the residual or excess toner remaining on the surface of the photoconductive member is removed therefrom after the transfer of the toner image to the copy paper. When the cleaning unit is a so-called blade cleaning unit equipped with a blade member which has a forward edge in pressing contact with the photoconductive surface, dust particles tend to agglomerate at the forward edge portion of the blade member to raise the forward edge of the blade member by the agglomerated dust particles, possibly holding the blade member locally out of proper pressing contact with the photoconductive surface. This seriously impairs the residual toner removing function of the blade cleaning unit.

Moreover, with the above described type of copying apparatus provided with a device by which the residual toner removed from the surface of the photoconductive member is recovered and then returned to the developing unit for reuse in developing latent electrostatic images, dust particles may mingle with the developer in the developing unit, thereby degrading the developer especially in its transportability and exerting an adverse effect on the development of the latent images. The dust also produces blank dots or the like on the copy image.

Accordingly, it is highly desirable to eliminate the above problems and their consequent drawbacks, especially with the toner image transfer type electrophotographic copying apparatus.

SUMMARY OF THE INVENTION

A main object of the present invention is to provide an improved image transfer type copying apparatus.

Another object of the present invention is to provide an improved image transfer type copying apparatus in which the foregoing problems arising from the production and presence of dust are overcome.

Another object of the present invention is to provide an image transfer type copying apparatus having an improved dust removing assembly of simple construction and reliable and efficient operation.

Still another object of the present invention is to provide an improved electrophotographic copying apparatus of the toner image transfer type.

The above and other objects of the present invention are achieved by the provision of an image transfer type copying apparatus comprising a pair of transport rollers provided in the path of transport of transfer paper from a paper feed station to an image transfer station for delivering the transfer paper directly to the transfer station, and a member in pressing contact with the surface of at least one of the transport rollers for triboelectrically charging the surface of the roller.

In accordance with a preferred embodiment of the present invention, the objects of the invention are achieved by an image transfer type copying apparatus comprising a first transport roller provided in the path of transport of transfer paper from a paper feeding station to an image transfer station and disposed immediately trailing or in front of the transfer station, a second transport roller paired with and opposed to the first transport roller to engage the rear face of the advancing transfer paper, the pair of first and second transport rollers performing the function of feeding the transfer paper directly to the transfer station while engaging the transfer paper therebetween, a charging member in pressing contact with the surface of the first transport roller for cleaning the roller surface and for triboelectrically charging the roller surface to a predetermined polarity, first means for longitudinally retracting the charging member out of pressing contact with the surface of the first transport roller by moving the member parallel to the axis of the first transport roller, and second means for cleaning the charging member when such member is moved by the first means toward a position where the charging member is out of pressing contact with the roller surface.

The above and other objects, advantages and features of the present invention will become apparent from the following description thereof taken in conjunction with the accompanying drawings which illustrate a preferred embodiment of the present invention.

BRIEF DESCRIPTION OF THE DRAWINGS

In the following description, like parts are designated by like reference numbers throughout the several drawings.

DESCRIPTION OF THE PREFERRED EMBODIMENT

Figure 1:
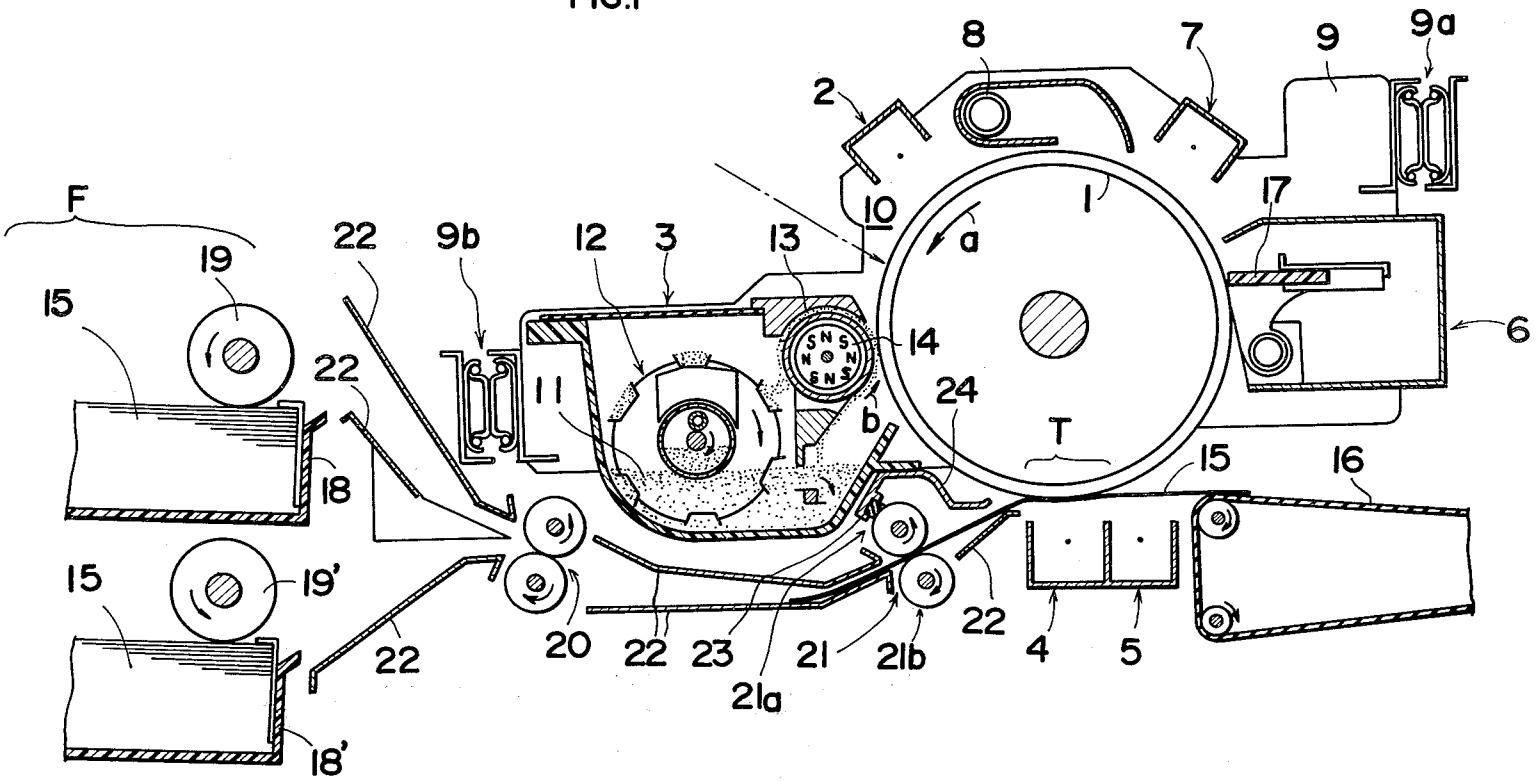
FIG. 1 is a fragmentary longitudinal sectional view of an image transfer type copying apparatus embodying the present invention.

Referring now to the drawings which illustrate the main portion of the interior structure of a toner image transfer type electrophotographic copying apparatus constituting a preferred embodiment of the present invention, the reference numeral 1 generally designated an electrophotographic photoconductive drum 1 which is rotatable counter-clockwise in the direction of arrow a as shown in FIG. 1 of the drawing. Positioned around the drum 1 sequentially in the direction of the arrow a are image forming elements, including a sensitizing charger 2, an image developing unit 3, a transfer charger 4, a separating charger 5, a cleaning unit 6, a sensitivity increasing charger 7, an eraser lamp 8, etc. The sensitizing charger 2, developing unit 3, cleaning unit 6, sensitivity increasing charger 7 and eraser lamp 8 are mounted on and assembled into a unit by a side plate 9 along with the photoconductive drum 1. The unit assembly is slidably supported by slide rails 9*a* and 9*b* on the main body of the copying apparatus to facilitate its retraction toward the front side of the main body for the maintenance of the image forming elements.

The drum 1 is rotatably driven by an unillustrated drive mechanism in the direction of the arrow a with the start of a copying operation. While in rotation, the photoconductive surface of drum 1 is uniformly charged by the sensitizing charger 2 and is then exposed to the image of an original at an exposure station 10 by an unillustrated exposure device, which may be of the conventional scanning type optical system, whereby a latent electrostatic image corresponding to the image of the original is formed on the photoconductive peripheral surface of the drum 1. The electrostatic latent image on the photoconductive surface is advanced and developed to a toner image by the developing unit 3.

The developing unit 3 includes a bucket roller 12 for stirring and conveying a magnetic developer 11 comprising a mixture of a magnetic carrier and a toner, and a developing sleeve 13 and a magnetic roller 14 which are rotated in the direction of the arrow a as seen in FIG. 1. The developer stirred and conveyed by the bucket roller 12 and magnetically attracted to the peripheral surface of the developing sleeve 13 is carried over the sleeve surface in a direction opposite to the direction of the arrow b into contact with the surface of the drum 1. As a result, the latent electrostatic image on the drum surface is converted to the toner image.

The toner image is electrostatically transferred by the electrostatic action of the transfer charger 4 onto the surface of a copy or transfer paper sheet 15 which is advanced in timed relation with the rotation of the drum 1, from a paper feeding station F to an image transfer station T along the path of transport of the transfer paper as will be hereinafter described.

Moreover, the transfer paper 15 intimately engaging to the surface of drum 1 by being superimposed on the drum surface at the transfer station T for the transfer of the toner image is electrically separated from the drum surface by the electrostatic action of the separating charger 5 so that the paper may be fed to an unillustrated toner image fixing unit by a conveyor belt 16. The toner remaining on the surface of the drum 1 following the transfer of the toner image is scraped off and recovered from the drum surface by the cleaning blade 17 of the cleaning unit 6 and is automatically returned to the interior of the developing unit 3 by unillustrated conveying means so as to be reused for development. After the removal of the residual toner, the surface of the drum 1 is charged by the sensitivity increasing charger 7 and then entirely exposed to the light of the eraser lamp 8 in preparation for the subsequent formation of a latent electrostatic image.

Sheets of transfer paper 15 of different sizes are accommodated in a plurality of cassettes 18 and 18' at the feeding station F. Either one of feed rollers 19 and 19' provided for the cassettes 18 and 18', respectively, is selectively driven with the start of a copying operation, whereby a sheet of paper is discharged from the selected cassette into the path of advance of the paper sheet as delineated by guide plates 22. The transfer paper sheet 15 delivered from a respective cassette is advanced in timed relation with the rotation of the photoconductive drum 1, by two pairs of transport rollers 20 and 21, along the path delineated by the guide plates 22 and is brought to the transfer station T, where the paper sheet 15 is superimposed on the drum surface. Concurrently, the toner image is transferred from the drum surface to the drum contacting surface of the paper sheet 15 by the electrostatic action of the transfer charger 4. The rollers 21 are controlled and timed to advance the leading edge of paper sheet 15 to coincide with the leading edge of the developed image on drum 1 and the peripheral speeds of the drum 1 and rollers 21 during paper advance are equal.

Figure 2:
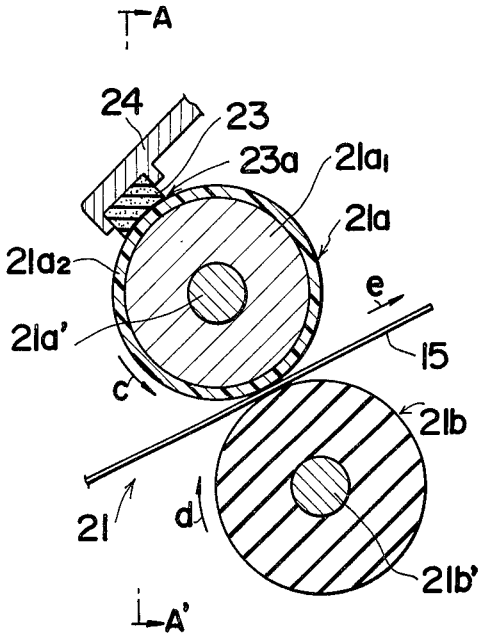
FIG. 2 is a fragmentary detailed enlarged sectional view of the improved dust removing assembly included in the copying apparatus of FIG. 1.

Of the two pairs of transport rollers 20 and 21 arranged in the path of transport of the paper extending from the feeding station F to the transfer station T, the pair 21 positioned immediately trailing or in front of the transfer station T comprises an upper roller 21*a* disposed on the front side or image receiving face of the transported paper sheet 15 and a lower roller 21*b* on the rear side or face of the paper. As seen in FIG. 2, the upper roller 21*a* includes a metal core or substrate $21a_1$ and a covering layer $21a_2$ superimposed on the peripheral surface of the metal core and made of a highly electrically insulating material, such as polytetrafluoroethylene, vinyl chloride, a polyester or polyethylene. The lower roller 21*b* is made of insulating rubber. The pair of transport rollers 21 functions to feed the transfer paper 15 directly to the transfer station T and functions also as a component of a dust removing assembly for removing dust from the transfer paper 15. The upper roller 21*a* may be entirely made of a phenolic resin or the like.

A cleaning pad 23 made of a material, such as nylon, rayon, polyurethane foam or cotton, which will triboelectrically charge the surface of the upper roller 21*a* to a predetermined polarity is provided in pressing contact with the surface of the roller 21*a* at an upper portion of the roller 21*a* toward one side thereof. The cleaning pad 23 is fixed to a support plate 24 attached to a lower portion of the casing of the developing unit 3 and is retractable with the developing unit 3, i.e. with the aforementioned unit assembly, toward the front side of the apparatus main body.

In accordance with the illustrated preferred embodiment of the present invention, the covering layer 21$a_2$ of the upper roller 21*a* over the surface of metal core 21$a_1$ is formed of vinyl chloride and is smooth-surfaced. The lower roller 21*b* is formed of a synthetic rubber, namely NBR (a copolymer of acrylonitrile and isoprene or butadiene). The cleaning pad 23 in pressing contact with the surface of the upper roller 21*a* is formed of polyurethane foam which is a foamed elastic material. With the start of a copying operation, the upper roller 21*a* and the lower roller 21*b* are driven by an unillustrated drive mechanism in the direction of an arrow c and the direction of an arrow d, respectively, as shown in FIG. 2. Thus, the pair of rollers 21 transports the transfer paper sheet 15 in the direction of an arrow e and guides the paper 15 directly to the transfer station T. Concurrently, the upper roller 21*a* rotating in the direction of the arrow c is triboelectrically charged over its peripheral surface by the frictional or rubbing contact or engagement with the cleaning pad 23, with the result that the paper particles and other dust particles adhering to the leading edge of the transfer paper 15 and also to the surface thereof are electrostatically or physically attracted to the triboelectrified surface of the upper roller 21*a* during the transport of the paper 15. The paper and like dust particles attracted to the surface of the upper roller 21*a* are separated from the roller surface by an edge portion 23*a* of the cleaning pad 23 and collected in the vicinity of the edge portion 23*a*. The collected dust particles are removed by the means shown in FIG. 3 when the cleaning pad 23 fixed to the support plate 24 is withdrawn with the unit assembly toward the front side of the apparatus main body.

Figure 3:
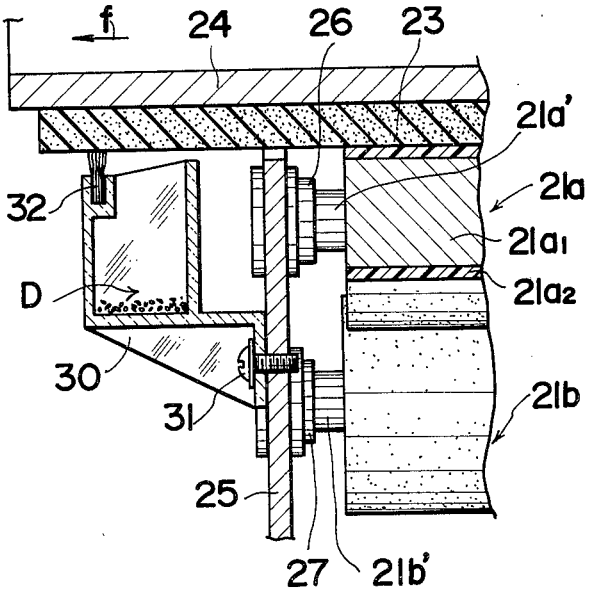
FIG. 3 is a sectional view taken along the line A-A' in FIG. 2 and showing the dust removing assembly.

Referring to FIG. 3, the shafts 21*a*' and 21*b*' of the transport rollers 21*a* and 21*b* are mounted by bearings 26 and 27 respectively on an inner side plate 25 at the front side of the apparatus main body. A container 30 for collecting the paper and other dust particles D is detachably fastened to the side plate 25 by screws 31. The container 30 is made of transparent resin, so that the amount of dust D therein is easily visible from outside. A brush 32 is fixed to an upper edge of the container 30 at the front side of the main body and extends at least to the level of and across pad 23. When the unit assembly is withdrawn toward the front side of the main body, that is, in the direction of the arrow f parallel to the shaft 21*a*' of the upper roller 21*a*, the brush 32 brushes and thereby cleans the cleaning pad 23, whereby the dust particles separated from the surface of the upper roller 21*a* and adhering to the pad 23 are released from the pad and fall into the container 30. Thus when the unit assembly is pulled out for the maintenance of the image forming elements within the main body of the copying apparatus, the dust collected in the vicinity of the edge portion 23*a* are automatically separated and deposited into the container 30. By the withdrawal of the unit assembly from the apparatus main body, the cleaning pad 23 is moved in the direction of the arrow f to a position where it is out of pressing contact with the upper roller 21*a*.

Since the copying apparatus according to the above described embodiment has incorporated therein a dust removing assembly comprising the pair of transport rollers 21 and cleaning pad 23, the paper particles and like dust particles adhering to the transfer paper are removed therefrom immediately before the paper is delivered to the photoconductive drum 1. While the dust particles on the transfer paper, if transferred to the drum surface, would locally agglomerate between the edge of the drum cleaning blade and the drum surface to prevent complete and proper cleaning, such a problem is reliably and efficiently overcome by the present improved dust removing assembly. Notwithstanding that the residual toner recovered by the cleaning blade is reused for developing latent electrostatic images, the improved dust removing assembly further eliminates the likelihood that the dust will mingle with the developer in the developing unit.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

For example, even if the dust removing assembly is adapted to remove dust only from the leading edge of the transfer paper, the problems already described are fully avoidable. In this case, the cleaning pad 23, which is provided for the upper roller 21*a*, may alternatively be pressed against the lower roller 21*b*.

What is claimed is:

1. An image transfer type copying apparatus comprising a pair of confronting transport rollers located in the path of advance of a cut sheet of transfer paper from a paper feeding station to an image transfer station for advancing the cut sheet of transfer paper directly to the transfer station, and a member in pressing contact with the surface of at least one of the transport rollers for triboelectrically charging the surface of the roller whereby said roller cooperates in said advancing of said sheet and electrostatically removes dust particles from a surface thereof.

2. An image transfer type copying apparatus comprising a first transport roller located in the path of advance of a cut sheet of transfer paper from a paper feeding station to an image transfer station and disposed immediately before the transfer station, a second transport roller opposing the first transport roller to engage the rear face of the transfer paper sheet being advanced by the rollers, the pair of first and second transport rollers functioning to advance the cut sheet of transfer paper directly to the transfer station while holding the paper therebetween, and a member in pressing contact with the surface of the first transport roller for cleaning the roller peripheral surface and triboelectrically charging the roller surface to a predetermined polarity whereby said charged roller cooperates in said advancing of said cut sheet and electrostatically removes dust particles from a surface thereof.

3. An image transfer type copying apparatus as claimed in claim 2, wherein said first transport roller is provided with an electrically insulating peripheral surface.

4. An image transfer type copying apparatus as claimed in claim 3, further comprising first means for retracting said member out of pressing contact with the surface of the first transport roller by moving the member parallel to the longitudinal axis of the first transport roller.

5. An image transfer type copying apparatus as claimed in claim 4, further comprising second means for cleaning said member when the member is retracted by the first means toward a position where the member is out of pressing contact with the roller surface.

6. In an electrostatic copying machine of the image transfer type including a rotatable member having a peripheral photoconductive surface and means for producing an image of an original on said photoconductive surface and means at an image transfer station for transferring said image from said photoconductive surface to a first face of a transfer medium advanced in engagement with said image bearing photoconductive surface, an apparatus for removing dust from said transfer medium comprising: a pair of cooperating confronting parallel rollers positioned in the immediate proximity of said transfer station for advancing a cut sheet of said transfer medium directly into image transfer engagement with said photoconductive surface at said transfer station and rotated at a peripheral speed equal to that of said photoconductive surface and to the linear speed of advance of said cut sheet and in timed relation with the advance of said photoconductive surface carried image and cleaning means for electrostatically charging the peripheral surface of a first of said rollers engaging the surface of said sheet of transfer medium advanced into image transfer engagement with said photoconductive surface, whereby said first roller cooperates to advance said sheet of transfer medium and electrostatically attracts and withdraws dust from said surface of said transfer medium sheet engaged and advanced by said rollers.

7. The apparatus of claim 6 wherein said cleaning means comprises a charging member extending lontigudinally along and in rubbing engagement with the peripheral surface of said first roller and being formed of a material to triboelectrically charge said first roller peripheral surface with the relative movement thereof.

8. The apparatus of claim 7 wherein said first roller peripheral surface is formed of a dielectric material.

9. The apparatus of claim 8 wherein said charging member is formed of an elastic polymeric resin material and additionally functions to wipe the dust from the surface of said first roller.

10. The apparatus of claim 9 wherein said charging member is retractable from the surface of said first roller and further comprising means for removing dust from said retracted charging member.

11. The apparatus of claim 10 wherein said charging member is longitudinally retractable and said dust removing means comprises a brush located in the longitudinal path of movement of said charging member.

* * * * *